United States Patent [19]

Yamada et al.

[11] 4,409,026

[45] Oct. 11, 1983

[54] SPRING STEEL FOR VEHICLES

[75] Inventors: Yoshiro Yamada, Akashi; Nobuyasu Hatsuoka, Itami; Shinzo Ashida, Kobe, all of Japan

[73] Assignee: Kabushiki Kaisha Kobe Seiko Sho, Kobe, Japan

[21] Appl. No.: 274,414

[22] Filed: Jun. 17, 1981

[30] Foreign Application Priority Data

Jun. 26, 1980 [JP] Japan ..... 55-86955

[51] Int. Cl.[3] ..... C22C 38/24; C22C 38/34

[52] U.S. Cl. ..... 75/124; 75/126 E; 75/126 Q; 148/36

[58] Field of Search ..... 148/12 B, 12 F, 12.4, 148/36; 75/126 E, 126 Q, 124 B

[56] References Cited

U.S. PATENT DOCUMENTS

| | | | |
|---|---|---|---|
| 3,647,571 | 3/1972 | Okamoto et al. | 148/154 |
| 3,847,678 | 11/1974 | Furr | 148/36 |
| 4,046,600 | 9/1977 | Yamakoshi et al. | 148/36 |

FOREIGN PATENT DOCUMENTS

| | | | |
|---|---|---|---|
| 2238768 | 2/1975 | France | 148/12 B |
| 53-5245 | 2/1978 | Japan | 148/12 B |

*Primary Examiner*—Peter K. Skiff

*Attorney, Agent, or Firm*—Oblon, Fisher, Spivak, McClelland & Maier

[57] ABSTRACT

A spring steel for vehicles having a composition substantially composed of 0.5–0.7 wt % of C, 1.0–1.8 wt % of Si, 0.1–1.0 wt % of Mn, below 0.7 wt % of Cr, 0.03–0.5 wt % of V and the balance of Fe and normally present impurities, and optionally at least one of Al, Zr, Nb and Ti each contained in an amount of 0.02–0.1 wt %.

6 Claims, 7 Drawing Figures

SPRING STEEL FOR VEHICLES

BACKGROUND OF THE INVENTION

1. Field of the Invention

This invention relates to alloy steels for use as suspension springs for vehicles. More particularly, it relates to compositions of Spring steels wires.

2. Description of the Prior Art

For the spring steel wires of the just-mentioned type, there have been heretofore mainly used steels of JIS SUP 6-7, but from a viewpoint of energy savings, it is required to make the vehicles lighter in weight. In addition, an expressway network has been fully developed with an increasing chance of travelling at high speeds. In the winter season of cold districts, it is often experienced to spray salt as one of measures against deep snows on road, so that suspension springs which are mounted in an environment completely different from valve springs incorporated in engine becomes susceptible to corrosion fatigue or delayed fracture. Accordingly, suspension springs which are one of important safety parts are required not only to have the performance as spring, but also to be reliable. Under these circumstances, hitherto employed spring steel wires are found to be disadvantageous in that they show a great settling or permanent set in fatigue and poor in resistance to corrosion fatigue or delayed fracture and that when they are imparted with high strenghs by heat treatment in order to improve the settling resistance, the reliability in performance is lost due to the lack of toughness.

It will be noted that the steel wires of the type to which the present invention is directed are known, for example, in Swedish Pat. No. 342,475 (corresponding to British Pat. No. 1,300,210), U.S. Pat. Nos. 1,972,524, 2,395,687 and 3,528,088, Japanese Patent Publication No. 46-19420 and Russian Standards 60C 2 x A and 60C 2 x ΦA.

SUMMARY OF THE INVENTION

The suspension springs which overcome the above disadvantages should be small in permanent set and high in reliability of performance such as involving, by no means, breakage of the springs and should be made of materials which are easy in manufacture.

Accordingly, an object of the invention is to provide spring steels for suspension spring which show a small level of permanent set and a small relaxation value at a room temperature.

Another object of the invention is to provide spring steels which are high in fatigue strength and resistant to delayed fracture.

A further object of the invention is to provide spring steels which can be easily processed including the rolling and drawing and the manufacture of springs from the wires.

A still further object of the invention is to provide spring steels for automobiles which show a highly reliable performance when applied as suspension springs.

As a result of an intensive study on spring steels, it has been found that the above objects can be achieved by steels which comprises predetermined amounts of C, Si, Cr, V and Mn and, optionally, a specified amount of at least one of Al, Zr, Nb and Ti. That is, according to one aspect of the present invention, there is provided a spring steel for vehicles which has a composition substantially composed of 0.5-0.7 wt% of C, 1.0-1.8 wt% of Si, 0.1-1.0 wt% of Mn, below 0.7 wt% of Cr, 0.03-0.5 wt% of V and the balance of iron and normally present impurities. In another aspect of the invention, there is also provided a spring steel for vehicles which has a composition substantially composed of 0.5-0.7 wt% of C, 1.0-1.8 wt% of Si, 0.1-1.0 wt% of Mn, below 0.7 wt% of Cr, 0.03-0.5 wt% of V, at least one of 0.02-0.1 wt% of Al, 0.02-1.0 wt% of Zr, 0.02-0.1 wt% of Nb and 0.02-0.1 wt% of Ti, and the balance of Fe and normally present impurities.

The above and other objects, features and advantages of the present invention will become apparent from the following description and the appended claims, taken in conjunction with the accompanying drawings.

DETAILED DESCRIPTION OF THE INVENTION AND PREFERRED EMBODIMENTS

Figure 1:
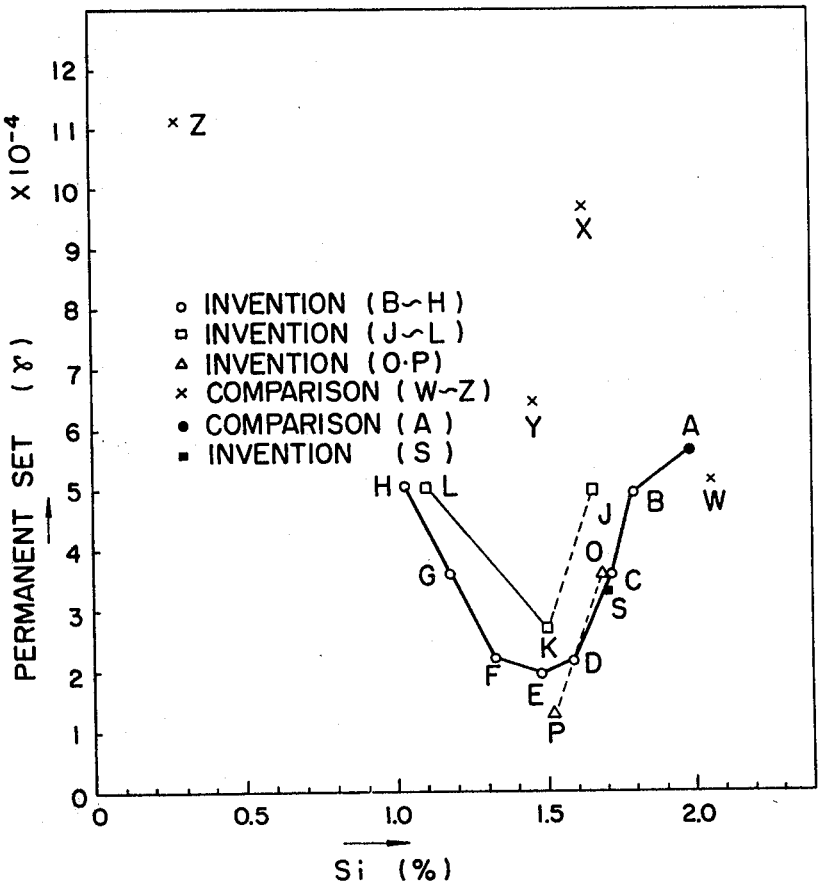
FIG. 1 is a diagrammatic illustration of the relationship between the permanent set developed in spring steel by applying a static load thereto and its Si content.

In the present invention, the ranges in amount of the respective additive elements are defined as mentioned above for reasons which follow.

First, the essential components contained in the steel composition of the invention, and including Si, Cr, Mn and V are described.

Si (silicon) is an element which is inexpensive and which is effective in improving the resistance to permanent set of coil springs obtained by quenching and tempering and/or oil tempering treatments. Less amounts than 1 wt% lead to much less effects. When the amount exceeds 1.8 wt%, the toughness of quenched and tempered steel materials is deteriorated and this is true even after the hot rolling of the materials. This tendency similarly appears in controlled rolling and also in controlled cooling after the rolling. Si serves to enhance the activity of C and facilitate decarburization of the rolled and heat-treated steel materials. However, it causes to form non-metallic inclusions during the course of steelmaking operation, thus lowering the reliability in performance of a suspension spring. Accordingly, the amount of Si is determined to be in the range of 1.0-1.8 wt% of the composition. Preferably, the amount is in the range of 1.3–1.6 wt% and a reason for this will be experimentally illustrated hereinafter.

When added in large amounts, Cr (chromium) shows a tendency of increasing a relaxation value of steel materials which have been quenched and tempered. However, less amounts than 0.7 wt% and particularly 0.55 wt% give a less influence on the relaxation value. In addition, Cr serves to slightly deteriorate the toughness of steel materials which have been quenched and tempered but in amounts less than 0.7 wt%, its influence is small. On the other hand, Cr serves to impart toughness to hot rolled steels and ensures the stability and reliability of a wire-drawing process, after the hot rolling, without involving any heat treatment. In this connection, less amounts than 0.3 wt% are relatively small in effect. On the contrary, larger amounts than 0.7 wt% are disadvantageous in that the hardenability increases, showing a great possibility or tendency that when hot rolled, the steel is converted into the bainite or martensite structure with the attendant deterioration of toughness. This tendency similarly takes place in the controlled rolling and controlled cooling after the hot rolling. Cr acts to lower the activity of C and is useful in preventing decarburization at the time of heat treatment, thus being useful in increasing the reliability of quality. These effects are not significant when the amounts are less than 0.3 wt%. Accordingly, the amount of Cr is generally in the range of below 0.7 wt%, preferably below 0.55 wt% and most preferably 0.3–0.55 wt%.

V (vanadium) is an element which serves to increase the resistance to permanent set and is useful in preventing the decarburization similarly to Cr. Vanadium is added to steel materials in order that crystal grains are refined to impart toughness to the material and improve the resistance to delayed fracture, thus improving the reliability of performance. Less amounts than 0.03 wt% result in a reduced effect whereas larger amounts than 0.5 wt% are not favorable because of its expensiveness and also of a difficulty in steel-making process. Accordingly, the amount of V is in the range of 0.03–0.5 wt%.

C (carbon) is a necessary component for imparting room temperature strengths to steel wires but it is needed to limit amount of C when high strengths are required accompanied by the light weight of vehicles. Less than 0.5 wt% does not lead to satisfactory strengths of the wires and amounts exceeding 0.7 wt% are unfavorable because the toughness is impeded. Accordingly, the amount of C is determined to be in the range of 0.5–0.7 wt%.

Mn (manganese) is a component useful in precluding the ill effect of S (sulfur) and also in deoxidation but shows little effect when used in amounts less than 0.1 wt%. Mn does hardly serve to improve the resistance to permanent set. When the amount exceeds 1 wt%, the hardenability increases on hot rolling, resulting in a great possibility that the structure of steel is converted into bainite or martensite. As a consequence, the toughness becomes so poor that the ease and stability in manufacture of steel wires is impeded. Accordingly, the amount of Mn has been determined to be in the range of 0.1–1 wt%. The above tendency similarly occurs in the controlled cooling after the hot rolling or in the controlled rolling.

As will be appreciated from the above, the micro structure of the steel according to the invention is preferably tempered martensite.

The steel composition incorporated with the aforedescribed metal components shows satisfactory properties for use as a suspension spring for vehicles. In order to further improve the properties and reliability of the spring steel, it is preferable to add one or more of Al, Zr, Nb and Ti to the composition. These metal components are then described.

Al (aluminium) serves to make fine a grain size by combination with nitrogen in steel and impart toughness to the steel along with an increasing resistance to the permanent set. These effects are not developed when the amount is less than 0.02 wt%. Larger amounts than 0.1% involve a difficulty in steel-making process. Accordingly, the amount of Al has been determined to be in the range of 0.02–0.1 wt%. Zr, Nb and Ti show effects similar to those of Al and are, respectively, used in amounts of 0.02–0.1 wt% since less amounts than 0.02 wt% are not effective whereas larger amounts than 0.1 wt% involve a difficulty in steel-making process.

When the steels of the invention are subjected to cleansing treatments such as an addition of Ca or rare earth elements to pig iron or molten steel and blowing of Ar gas into pig iron or molten steel in order to obtain clean steel and to reduce impurity elements and nonmetallic inclusions or mitigate segregation such as by deoxidation, desulfurization, dephospharization or the like, no ill influence on the steels is involved and thus the steels undergoing these treatments are also within the scope of the invention.

The present invention is then particularly described by way of examples. Comparative Examples are also described.

In order to compare permanent sets of coil springs made of steel wires conventionally employed as springs and steel wires according to the invention by static and dynamic tests conducted at a room temperature and also to check a relaxation characteristic and a delayed fracture property of oil tempered wires, 23 steels shown in Table 1 appearing hereinafter were provided and subjected to suitable quenching and tempering treatments so that the tensile strength was 185 kg/mm$^2$.

EXAMPLE 1

Figure 2:
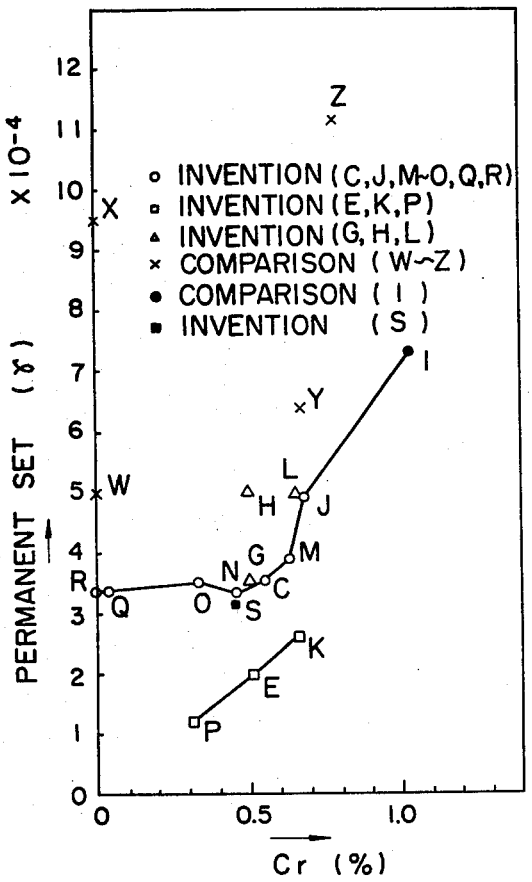
FIG. 2 is a diagrammatic illustration of the relationship between the permanent set developed in spring steel by applying a static load thereto and its Cr content.
Figure 3:
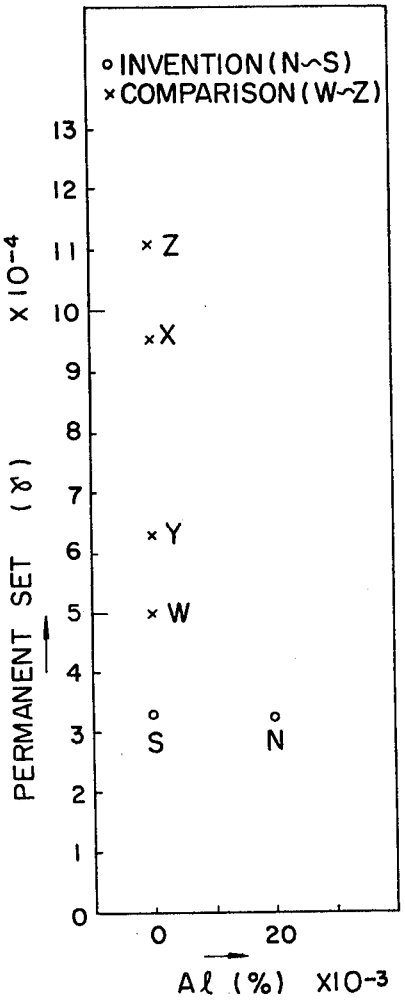
FIG. 3 is a diagrammatic illustration of the relationship between the permanent set developed in spring steel by applying a static load thereto and its Al content.

Steel Nos. B-H and J-S of the invention and comparative steels each having such a composition as shown in Table 1 appearing hereinafter were provided and each used to make a coil spring having a spring constant of 2.5 and set at a stress of 120 kg/mm$^2$. Each spring was subjected to a permanent set test (static test) in which a constant stress of 110 kg/mm$^2$ was continuously applied to the spring sample over 144 hrs. at a room temperature, with the results shown in the table and also in FIGS. 1–3. FIGS. 1–3 show relationship between a permanent set and contents of Si, Cr and Al, respectively, from which it will be seen that the springs made of the inventive steels are superior to the comparative steels. Further, it will be also seen from FIG. 1 that the Si content is preferably in the range of 1.3–1.6 wt% with respect to the permanent set. FIG. 2 shows that the Cr content is preferably below 0.55 wt% and most preferably in the range of 0.3–0.55 wt%.

EXAMPLE 2

Figure 4:
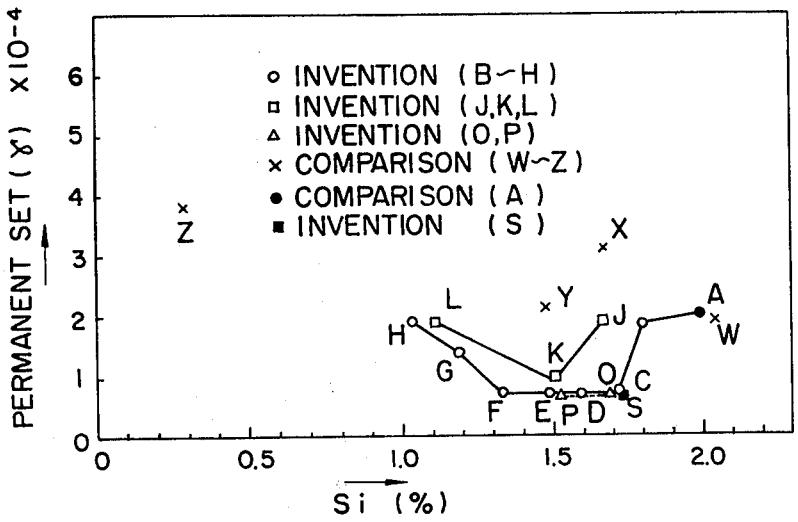
FIG. 4 is a diagrammatic illustration of the relationship between the permanent set developed in spring steel through the application of a dynamic load thereto and its Si content.
Figure 5:
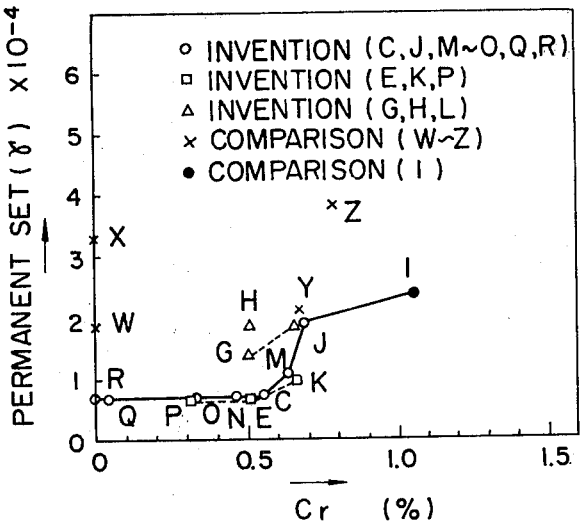
FIG. 5 is a diagrammatic illustration on the relationship between the permanent set developed in spring steel through the application of a dynamic load thereto and its Cr content.
Figure 6:
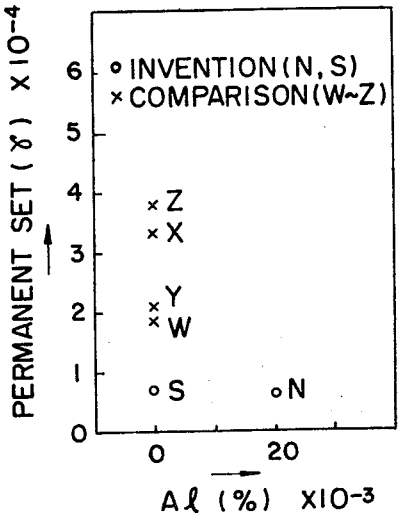
FIG. 6 is a diagrammatic illustration of the relationship between the permanent set developed in spring steel through the application of a dynamic load thereto and its Al content.

Inventive and comparative springs obtained in the same manner as in Example 1 were applied with a repeated stress such that an mean stress was 65.0 kg/mm$^2$ and an amplitude of the stress was 50 kg/mm$^2$ (dynamic test). The permanent set of each sample applied with the stress 200,000 times at a room temperature is shown in Table 1 and in in FIGS. 4–6, in which relationships between a permanent set and contents of Si, Cr and Al are, respectively, shown. From the table and the FIGURES, it will be seen that the springs made of the steels B-H and J-S according to the invention are more excellent than those of the comparative steels A, I, W-Z and that similar tendencies are observed with respect to the setting characteristic in relation to the contents of the respective elements.

EXAMPLE 3

The springs were made of inventive steels C, D and F and comparative steels W-Z in the same manner as in Example 1 and were each subjected to a fatigue test where a dynamic stress was repeatedly applied to each sample, until it was broken down at a room temperature or the number of repetitions reached 350,000, such that an mean stress was 65 kg/mm$^2$ and an amplitude of the stress was 50 kg/mm$^2$. The test results are shown in the table, revealing that the invention steels C, D and F show the fatigue life equal to or higher than the comparative steels W-Z.

EXAMPLE 4

Figure 7:
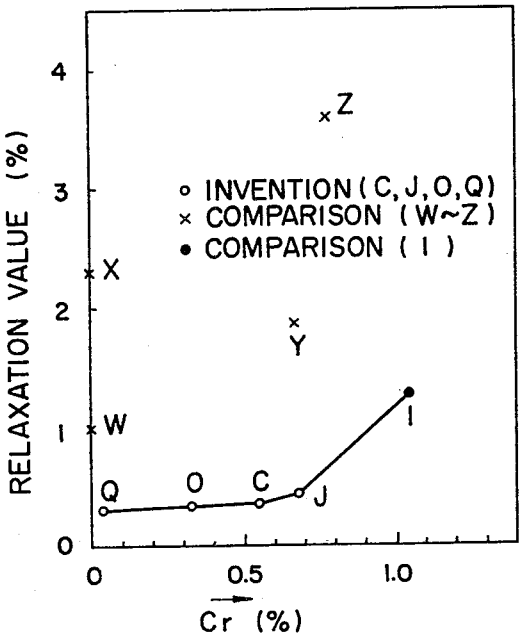
FIG. 7 is a diagrammatic illustration of the relationship between the relaxation value of a spring steel and its Cr content.

A relaxation test was conducted on several inventive samples and comparative samples shown in the table in such a way that an oil tempered wire of 7.0 $\phi$ was used and continuously applied with a constant load so that an initial load was 70% of a tensile rupture load. The results are in the table and in FIG. 7 in which a relation between a relaxation value and a content of Cr is depicted.

From these results, it will be seen that the inventive steels C, J, O and Q are smaller in relaxation value than the comparative steels I, W-Z.

EXAMPLE 5

An oil tempered wire made of each of the inventive steels C, D and F and the comparative steels W-Z and having a tensile strength of 185 kg/mm$^2$ was applied with a bending stress so that the radius of curvature was 0.5 cm and allowed to stand in water for 1 month thereby determining a delayed fracture in water. The test results are shown in the table, revealing that the steels C, D and F of the invention are more excellent in delayed fracture than the comparative steels W-Z.

In the following Table 1, permanent set ($\gamma$) is obtained by the following equation;

$$\gamma = \frac{d \cdot G}{\pi \cdot n \cdot D^2} \cdot (H_1 - H_2)$$

wherein, d: diameter of a wire
n: number of active coils
D: mean diameter of a coil
G: modulus of elasticity in shear
$H_1$: free height before testing
$H_2$: free height after testing

TABLE

| Steel No. | Steel | Chemical constituents | | | | | | | | |
|---|---|---|---|---|---|---|---|---|---|---|
| | | C | Si | Mn | P | S | Cr | Al | V | Fe |
| A | Comparative steel | 0.62 | 1.99 | 0.42 | 0.011 | 0.008 | 0.51 | 0.026 | 0.20 | balance |
| B | Inventive steel | 0.60 | 0.80 | 0.44 | 0.010 | 0.009 | 0.48 | 0.024 | 0.19 | " |
| C | Inventive steel | 0.61 | 1.72 | 0.45 | 0.009 | 0.009 | 0.55 | 0.025 | 0.20 | " |
| D | Inventive steel | 0.63 | 1.59 | 0.46 | 0.010 | 0.008 | 0.54 | 0.021 | 0.21 | " |
| E | Inventive steel | 0.62 | 1.48 | 0.44 | 0.010 | 0.009 | 0.51 | 0.025 | 0.19 | " |
| F | Inventive steel | 0.60 | 1.33 | 0.46 | 0.009 | 0.008 | 0.53 | 0.026 | 0.20 | " |
| G | Inventive steel | 0.61 | 1.18 | 0.43 | 0.010 | 0.009 | 0.49 | 0.023 | 0.20 | " |
| H | Inventive steel | 0.62 | 1.03 | 0.45 | 0.011 | 0.008 | 0.50 | 0.022 | 0.19 | " |
| I | Comparative steel | 0.60 | 1.71 | 0.42 | 0.013 | 0.010 | 1.05 | 0.025 | 0.19 | " |
| J | Inventive steel | 0.62 | 1.66 | 0.49 | 0.012 | 0.013 | 0.68 | 0.023 | 0.19 | " |
| K | Inventive steel | 0.64 | 1.50 | 0.41 | 0.012 | 0.012 | 0.66 | 0.022 | 0.20 | " |
| L | Inventive steel | 0.65 | 1.10 | 0.40 | 0.012 | 0.012 | 0.65 | 0.020 | 0.19 | " |
| M | Inventive steel | 0.61 | 1.71 | 0.45 | 0.009 | 0.009 | 0.63 | 0.025 | 0.20 | " |
| N | Inventive steel | 0.63 | 1.73 | 0.44 | 0.012 | 0.010 | 0.46 | 0.022 | 0.20 | " |
| O | Inventive steel | 0.61 | 1.69 | 0.47 | 0.011 | 0.011 | 0.33 | 0.026 | 0.20 | " |
| P | Inventive steel | 0.61 | 1.52 | 0.42 | 0.010 | 0.009 | 0.31 | 0.023 | 0.20 | " |
| Q | Inventive steel | 0.64 | 1.70 | 0.43 | 0.012 | 0.014 | 0.04 | 0.021 | 0.19 | " |
| R | Inventive steel | 0.63 | 1.70 | 0.44 | 0.012 | 0.013 | — | 0.022 | 0.19 | " |
| S | Inventive steel | 0.63 | 1.71 | 0.44 | 0.010 | 0.010 | 0.45 | — | 0.20 | " |
| W | JIS SUS7 (SAE9260) | 0.61 | 2.03 | 0.87 | 0.022 | 0.018 | — | — | — | " |
| X | JIS SUP6 | 0.60 | 1.63 | 0.90 | 0.018 | 0.017 | — | — | — | " |

TABLE-continued

| Steel No. | Steel | Chemical constituents C | Si | Mn | P | S | Cr | Al | V | Fe |
|---|---|---|---|---|---|---|---|---|---|---|
| Y | SAE9254 | 0.56 | 1.46 | 0.70 | 0.016 | 0.008 | 0.67 | — | — | " |
| Z | JIS SUP9 (SAE5160) | 0.58 | 0.28 | 0.75 | 0.018 | 0.007 | 0.78 | — | — | " |

-continued

| Static Permanent Set (γ) of Ex. 1 ($\times 10^{-4}$) | Dynamic Permanent Set (γ) of Ex. 2 ($\times 10^{-4}$) | Relax-ation value of Ex. 4 (%) | Fatigue Limit of Ex. 3 (No. of Repetitions) | Resistance to Delayed Fracture of Ex. 5 |
|---|---|---|---|---|
| 5.50 | 1.99 | — | — | — |
| 4.81 | 1.86 | — | — | — |
| 3.48 | 0.73 | 0.32 | $>35 \times 10^4$ | No breakage |
| 2.03 | 0.69 | — | $>35 \times 10^4$ | No breakage |
| 1.81 | 0.70 | — | — | — |
| 2.10 | 0.71 | — | $>35 \times 10^4$ | No breakage |
| 3.50 | 1.39 | — | — | — |
| 4.98 | 1.89 | — | — | — |
| 7.21 | 2.35 | 1.22 | — | — |
| 4.85 | 1.89 | 0.39 | — | — |
| 2.58 | 0.98 | — | — | — |
| 4.93 | 1.88 | — | — | — |
| 3.85 | 1.08 | — | — | — |
| 3.30 | 0.70 | — | — | — |
| 3.47 | 0.71 | 0.33 | — | — |
| 1.17 | 0.67 | — | — | — |
| 3.37 | 0.69 | 0.31 | — | — |
| 3.37 | 0.69 | — | — | — |
| 3.32 | 0.72 | — | — | — |
| 5.00 | 1.91 | 1.00 | $>35 \times 10^4$ | Broken in 2 days |
| 9.57 | 3.38 | 2.31 | $34.2 \times 10^4$ | Broken in 3 days |
| 6.32 | 2.13 | 1.83 | $33.5 \times 10^4$ | Broken in 1 day |
| 11.10 | 3.85 | 3.58 | $29.4 \times 10^4$ | Broken in 1 day |

Having now fully described the invention, it will be apparent to one of ordinary skill in the art that many changes and and modifications can be made thereto without departing from the spilit or scope of the invention as set forth herein.

What is claimed is:

1. A suspension spring steel substantially composed of 0.5–0.7 wt% of C, 1.0–1.8 wt% of Si, 0.1–1.0 wt% of Mn, 0.3–0.55 wt% of Cr, 0.03–0.5 wt% of V, 0.02 to 0.1 wt% of Al and the balance of Fe and normally present impurities.

2. The spring steel according to claim 1 further comprising at least one of 0.02–0.1 wt% of Zr, 0.02–0.1 wt% of Nb and 0.02–0.1 wt% of Ti.

3. The spring steel according to claim 1 or 2, wherein the Si content is in the range of 1.3–1.6 wt%.

4. The spring steel according to claim 1 or 2, wherein the Mn content is in the range of 0.1–0.6 wt.%.

5. The suspension spring steel according to claim 1 or 2 wherein the micro structure of the steel is tempered martensite.

6. The suspension spring steel according to claim 1 or 2 wherein the steel is a quenched and tempered steel.

* * * * *